United States Patent [19]

Goldfarb et al.

[11] 3,931,974

[45] Jan. 13, 1976

[54] AIR TABLE GAME APPARATUS

[76] Inventors: Adolph E. Goldfarb, 4614 Monarca Drive, Tarzana, Calif. 91356; Erwin Benkoe, 17965 Medley Drive, Encino, Calif. 91316

[22] Filed: Feb. 15, 1974

[21] Appl. No.: 443,110

[52] U.S. Cl. ..... 273/126 R; 302/29; 214/1 BE

[51] Int. Cl.[2] ..... A63F 3/00

[58] Field of Search ..... 273/126 A, 127 R, 126 R, 273/127 B, 85 R, 119 B, 85 H, 94 H, 95 C, 85; 52/2; 214/1 BE; 302/29, 31

[56] References Cited

UNITED STATES PATENTS

| | | | |
|---|---|---|---|
| 709,144 | 9/1902 | Edgerly | 273/85 R |
| 2,824,739 | 2/1958 | Frank | 273/85 R X |
| 3,389,510 | 6/1968 | Stock | 52/2 |
| 3,722,888 | 3/1973 | Ducharme | 273/126 R |

FOREIGN PATENTS OR APPLICATIONS

| | | | |
|---|---|---|---|
| 375,454 | 6/1932 | United Kingdom | 273/85 R |

*Primary Examiner*—Richard J. Apley
*Assistant Examiner*—William R. Browne
*Attorney, Agent, or Firm*—Robert M. Ashen; Robert J. Schaap

[57] ABSTRACT

An improved air table for use in playing a game. The table has a perforated horizontal surface and means coupled to the underside of the surface to form an air chamber. This means may be in the form of a flexible sheet. An air pump forces air into the chamber and out through the perforations, thereby creating an air cushion on the upper playing side of the surface for facilitating the movement of one or more playing pieces over that upper playing side. The table may have goals and guard rails disposed in front of the goals to permit the playpiece to enter the goals while limiting the degree of blockage of the goal entrance.

15 Claims, 13 Drawing Figures

AIR TABLE GAME APPARATUS

BACKGROUND OF THE INVENTION

1. Field of the Invention

This invention relates to a game apparatus and more particularly to an air table on which a playing piece is movably supported by an air cushion.

2. Description of the Prior Art

It is known in the art to provide game apparatus utilizing an air table on which a playing piece is supported by an air cushion. An example of such apparatus is a hockey game manufactured by Brunswick Corporation. One version of this hockey game comprises a solid perforated rectangular top panel about 4 feet wide by about 8 feet long that is supported at a height of about 30 inches from the floor. A second solid rectangular panel is secured to the underside of the top panel. The panels are cut out to form a solid, rigid air chamber or manifold into which air is pumped to create an air cushion above the surface of the top panel upon escaping from the perforations. Since this unit is quite expensive and has a shipping weight of about 550 pounds, it is apparent that the market for such a unit is limited.

A principal object of the present invention is to provide air table apparatus which avoids the disadvantages of the prior art apparatus.

A more specific object of the invention is to provide an air table which is lightweight and inexpensive to manufacture.

Another object of the invention is to provide an air table which is convenient to store.

In accordance with one embodiment of the present invention, an air table is provided which has a perforated top surface or panel supported in an elevated position by a plurality of legs. A flexible sheet is coupled to the bottom periphery of the surface to form an air chamber, and means are provided for pumping air into the chamber. The air from the chamber passes upwardly through the perforations to form an air cushion above the top surface and one or more playing pieces are provided for moving over the surface on the cushion.

In a further aspect, the air table may have goals which are provided with guard means. The guard means afford access to the goals by a playpiece propelled over the top surface, but prevent the defending player from excessively blocking the entrance to his goal.

The novel features of the invention are set forth with particularity in the appended claims. The invention will best be understood from the following description when read in conjunction with the accompanying drawings.

IN THE DRAWINGS

FIG. 1 is a perspective view of a preferred embodiment of the invention;

FIG. 1*a* is a bottom view of the embodiment of FIG. 1;

Figure 1:
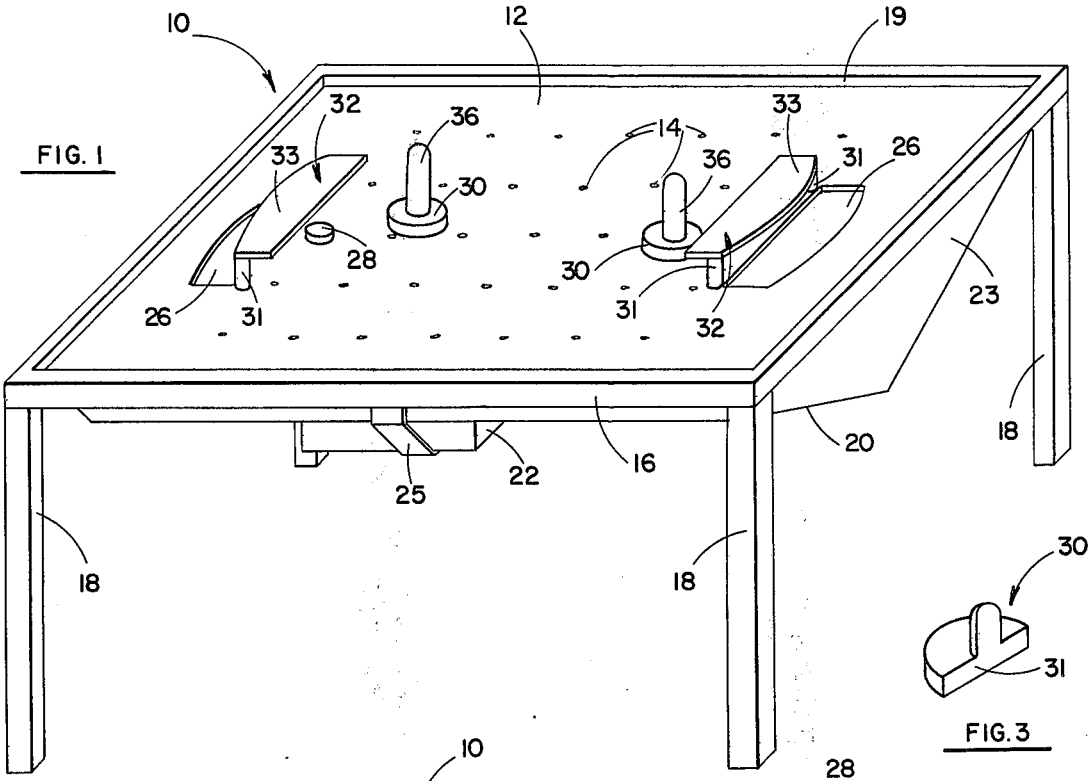
Figure 1A:
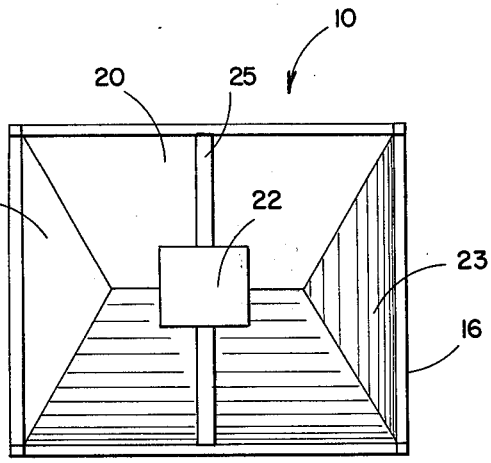

In FIG. 1 and 1*a*, a preferred embodiment of the present invention is illustrated. An air table 10 is shown having a rectangular, horizontal, generally rigid playing surface or panel 12 with a plurality of perforations or apertures 14 therethrough. The surface 12 is supported elevated above a support surface such as the floor by a rectangular frame 16 and four upright legs 18. The frame 16 provides a peripheral upright lip 19 around the surface 12. Beneath the playing surface 12 and attached to the periphery thereof is a flexible sheet 20 which combines with the surface 12 to form an air chamber or compartment 21. FIG. 1*a* shows a form of sheet configuration having end panels 23 which gives increased air volume at the ends. An air pump unit 22 may be secured to the sheet 20 and in communication with the chamber 21. The air pump unit 22 may be connected to an electrical power source (not shown) as by means of an electrical cord 24. Means such as flexible straps 25 secured to the frame 16 may be provided to aid in supporting the air pump unit 22. This also dampens vibrations. In this case, the pump unit 22 may be connected to the flexible sheet 20 through a tube 27 connected to a fitting 29 extending from and secured to the sheet 20. Alternatively, rigid support structures for the air pump unit could be provided.

Shown on the playing surface 12 are a pair of goals in the form of receptacles 26 opening onto the surface 12, a guard means 32 at each goal, a playing piece 28, and a pair of striker means 30. Each player uses a striker means 30 to hit the playing piece 28 to attempt to propel it into the opponent's goal 26. The lip 19 keeps the playing piece 28 confined to the playing surface 12. The goals 26 are spaced forwardly from the end of the table. Each guard means 32 is an open structure having a pair of upright legs 31 which support a transverse plate portion 33 positioned in front of a goal 26 and a predetermined height above the top of the playing surface 12. This allows the playing piece 28 to slide under the plate portion 33 while keeping the striking means away from directly in front of the goal 26; which makes it more difficult to guard the goal and adds to the excitement of play.

Figure 2:
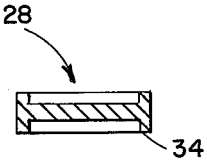
FIG. 2 is an enlarged cross-sectional view of the playing piece depicted in the FIG. 1.

The air pump unit 22 forces air into the space or chamber 21 created between the flexible sheet 20 and the playing surface 12. The air is forced out through the apertures 14 and creates an air cushion underneath the playing piece 28. As shown in FIG. 2, the playing piece 28 may have a skirt 34 extending around at least the bottom periphery thereof which traps air temporarily under the playing piece 28 and causes it to ride on an air cushion as it slides over the top of the playing surface 12.

Figure 3:
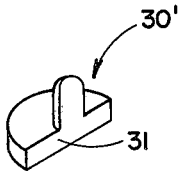
FIG. 3 depicts an alternate construction of the striker means illustrated in FIG. 1.

Each of the illustrated striker means 30 is generally cylindrical in shape. A handle 36 is attached to the striker means 30 so as to enable it to be manually moved and positioned by the player around the playing surface 12 to appropriately strike the playing piece 28. In FIG. 3 an alternate embodiment 30' of the striker means 30 is shown in which a portion of the cylindrical body has been flattened so as to present an extending striking surface 31 to the playing piece 28.

In FIGS. 4–8, various means are shown of coupling the flexible sheet 20 to the playing surface 12. It is apparent that the table will operate effectively with a certain amount of leakage out of the chamber 21.

Figure 4:
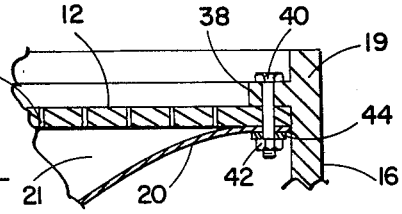

In FIG. 4, the frame 16 is shown having an inwardly directed peripheral flange 38. A plurality of bolts 40 pass through the flange 38, the peripheral edge of playing surface 12, and the peripheral edge of the flexible sheet 20. The bolts 40 are spaced at intervals around the periphery of the surface to secure the flexible sheet 20 to the playing surface 12. The bolts 40 may be secured in place by suitable means such as nuts 42. If a better seal is desired, a gasket 44 may be disposed beneath the flexible sheet 20. The flange 38 also serves to restrain upward movement of the surface 12.

Figure 5:
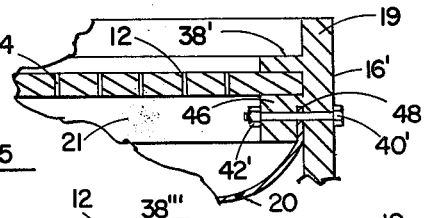

In FIG. 5, the playing surface 12 is firmly secured between an upper flange 38′ and a second lower flange 46. The frame 16′ may be comprised of convenient interconnecting sections to permit assembly in the illustrated interlocking relationship with the playing surface. The lower flange 46 has a slot 48 therein into which the peripheral edge of the flexible sheet 20 is received and held as by means of bolts 40′ and nuts 42′.

Figure 6:
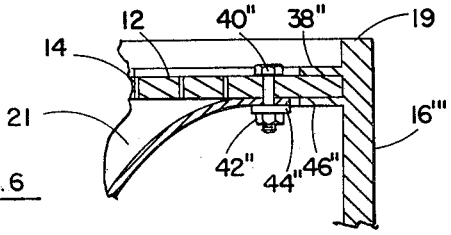

In FIG. 6, an upper flange 38″ and a lower flange 46″ are used merely to support the playing surface 12 while the flexible sheet 20 is directly coupled to the playing surface 12 by means of a gasket 44″, and bolts 40″ and nuts 42″.

Figure 7:
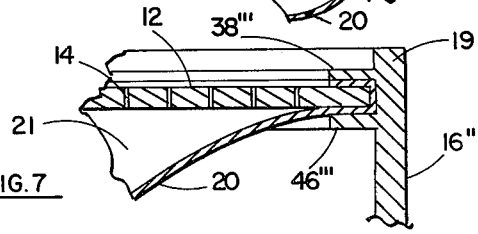

FIG. 7 shows the peripheral or marginal portions of the flexible sheet 20 wrapped around the top, side, and bottom edge of the playing surface 12, and wedged securely between an upper flange 38‴ and a second lower flange 46‴.

Figure 8:
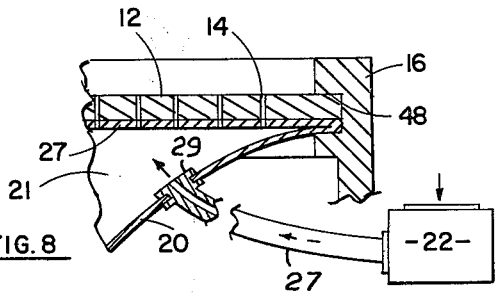
FIGS. 4–8 illustrate in enlarged cross-sectional views various configurations of the surface-sheet coupling.

FIG. 8 shows the sheet 20 in the form of a complete sack or bag having an upper wall 27 secured as by an adhesive to the underside of the perforated playing surface 12. The sheet upper wall 27 has perforations or openings which align with the perforations 14 in the surface 12. The peripheral edge of the surface 12 and the peripheral or marginal edge of the air bag may be received in a slot or groove 48 which extends around the inside of the frame 16.

Various design parameters may be used in constructing the air table 10. The playing surface 12 may be made of a material such as plywood or masonite. The flexible sheet 20 may be composed of a material such as heat-sealed vinyl, rubberized cloth, a fabric-reinforced vinyl, or a combination of such materials. As stated previously, there can be some leakage and still have the apparatus completely operable.

The air pump unit 22 should be able to provide an air pressure of between 1 and 5 psi. Satisfactory results have been achieved for 2 × 4 foot playing surface by using a ½ to ¾ horsepower motor running at 20,000 rpm. It is generally preferable, however, to run the motor at a lower rpm with a larger fan blade in order to reduce noise. In addition, it may be desirable to separate the air pump unit 22 from the chamber 21 as by having a flexible hose coupling the output of the air pump 22 and the flexible sheet 20. The air pump unit 22 could be disposed on the floor or could be mounted on the frame 16 or one of the legs 18. FIG. 8 shows a separate pump unit.

The legs can be made removable or foldable in order to be able to store the air table in a minimum of space; the flexible sheet will generally collapse against the play surface so that the table is readily reduced to the generally flat rectangular configuration of a folded bridge table.

Figure 9:
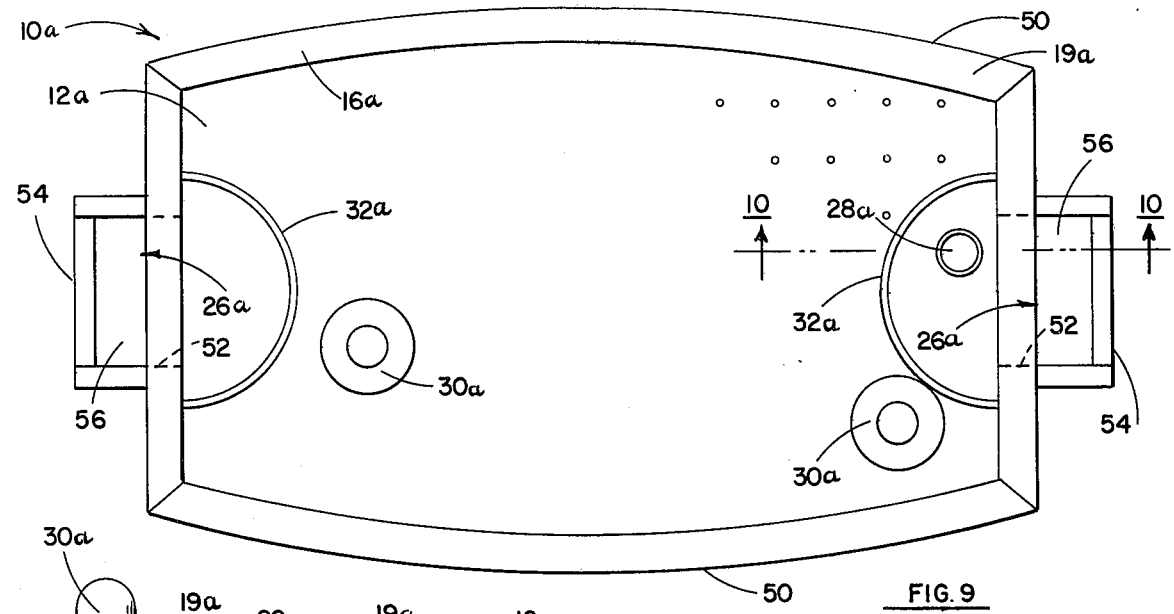
FIG. 9 is a plan view of an alternate construction table, including guard rails.
Figure 10:
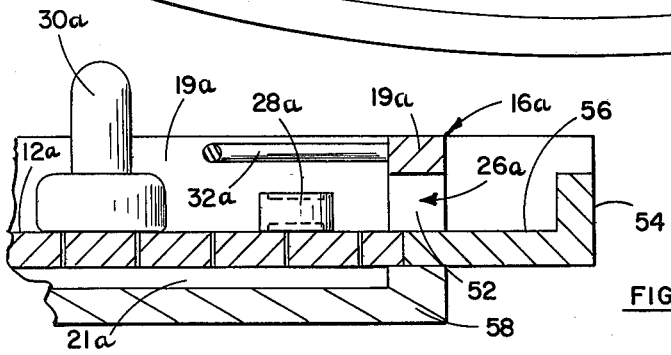
FIG. 10 is a partial side section taken generally along line 10—10 of FIG. 9.

FIGS. 9 and 10 show an alternative table construction 10*a*. The table 10*a* has a perforated top surface or panel 12*a* which is elongated and has outwardly curved side edges 50. A frame 16*a* surrounds and supports the panel 12*a*. The frame has an upright peripheral lip 19*a* around the edge of the surface 12*a* to confine the play piece 28*a*. Each player may have a striker means 30*a*.

At opposite ends of the surface 12*a*, goals 26*a* may be provided by openings 52 in the end wall sections of the peripheral lip 19*a*. These openings 52 may have their lower edge aligned with (or at least not higher than) the top surface 12*a* so that the play piece 28*a* may slide directly from the surface 12*a* into the goal. The illustrated goals 26*a* each includes an extension receptacle 54 secured to the end of the frame 16*a* immediately rearwardly of the associated opening 52 to receive the play piece 28*a* when a goal is scored. Each of the illustrated extension portions 54 has an opening 56 at the top which permits the player to reach in and push the play piece 28 back out onto the playing surface 12*a*. If desired, the extension 54 and the opening 56 may be large enough for withdrawing the play piece 28*a* through the opening 56, or other alternate means for retrieving the play piece after it has entered the goal may be utilized.

Each of the goals 26*a* is provided with guard or spacer means 32*a*. The illustrated means 32*a* are each a wire or rod bent into a semi-circular configuration and secured at its ends, to the end wall of the peripheral lip 19*a* above the goal opening or mouth 52. The means 32*a* is positioned high enough above the play surface 12*a* to permit the play piece 28*a* to slide thereunder, while it is low enough relative to the striker 30*a* to prevent the striker 30*a* from coming any closer to the goal opening than the position occupied by the guard means 32*a*. Thus, the striker 30*a* cannot be positioned directly in front of the goal mouth or opening. Instead, the striker 30*a* must be moved around the outside of the guard means or rail 32*a* in defending a player's own goal. This increases the amount of skill and agility required from the player as compared to that required if he were permitted to move his striker and maintain it directly in front of his goal. If desired, the guard rail 32*a* may be detachable to vary the skill required of the defender. For example, the guard rail 32*a* may be removed when the game is played by a younger child with more limited dexterity. Further, while the illustrated arrangement of guard means 32*a* has been found to be a desirable and practical arrangement, other configurations and sizes of guard rails may be utilized for particular game formats, player abilities, size and shape of strikers, play pieces, and goals, etc. It will be noted that the illustrated guard means 32*a* is supported away from the play surface itself so as to provide no interference with the movement of the play piece. This may be contrasted with the arrangement of guard means 32 shown in FIG. 1 where the upright support posts 31 do offer some potential interference with the movement of the play piece.

The table 10*a* is shown in FIG. 10 having an air chamber 21*a* formed between the top panel 12*a* and a lower panel 58, in lieu of the flexible sheet heretofore described.

Figure 11:
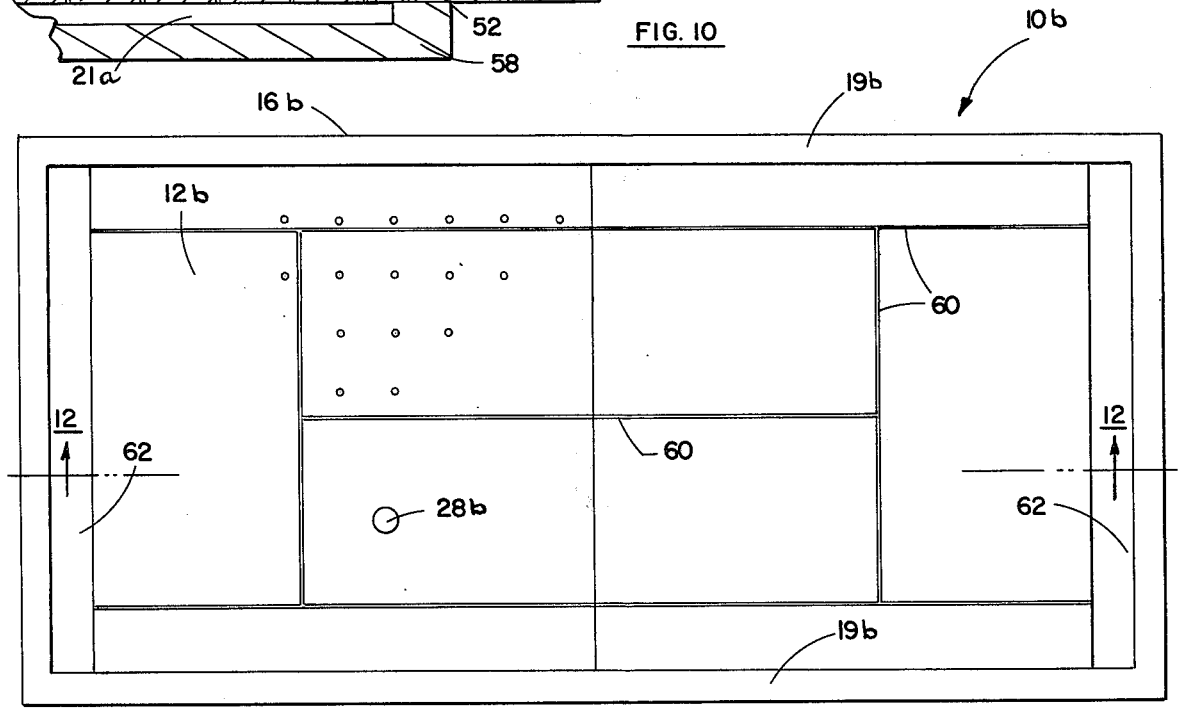
FIG. 11 is a plan view of another alternate construction table in the form of a tennis game.
Figure 12:
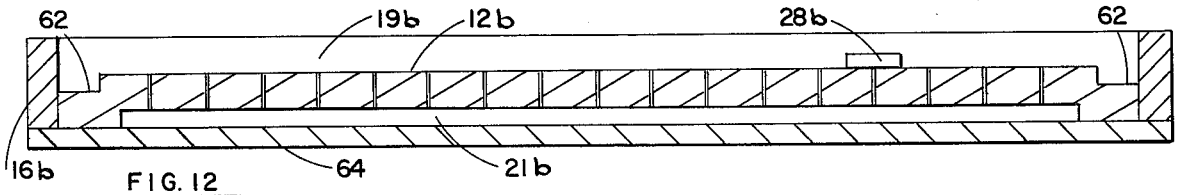
FIG. 12 is a side section taken generally along line 12—12 of FIG. 11.

FIGS. 11 and 12 illustrate still another modified form of air table 10*b*. This table has a perforated top panel 12*b* and a frame 16*b* secured to the edges of the panel 12*b*. The frame 16*b* provides a peripheral retaining lip 19*b*. The top panel 12*b* has indicia lines 60 representing a tennis court upon it. At each end the top panel 12*b* has a depression 62 which extends from side to side of the panel. This elongated depression 62 comprises the goal of this particular embodiment, which the player must defend against entry of the play piece 28*b*. This configuration of top panel 12*b* forms a recess at its underside which together with a bottom plate 64 secured to the underside of the frame 16*b* and/or portions of the panel 12*b* define the air chamber 21*b*.

Since the embodiment 10*a* and 10*b* have hard bottoms rather than the flexible chamber of table 10, table 10*a* and 10*b* may be used by placing them directly upon a supporting surface such as a table or the floor. Alternatively, they may also have legs or other support means.

Although particular embodiments of the invention have been described and illustrated herein, it is recognized that modifications and variations may readily occur to those skilled in the art, and, consequently, it is intended that the claims be interpreted to cover such modifications and equivalents.

What is claimed is:

1. A game apparatus capable of generating an air bearing surface for supporting a movable playing piece thereon by an air cushion, said apparatus comprising:

a. generally flat, relatively rigid, relatively horizontally disposed member having an upper surface defining a playing surface, b. means defining a plurality of apertures in said relatively horizontally disposed member capable of emitting air under pressure therethrough, c. a supporting structure retaining said relatively horizontally disposed member in upwardly spaced relationship to a floor or other supporting surface, d. an upstanding lip extending upwardly from said playing surface and around the periphery of said relatively horizontally disposed member, e. a flexible plastic member of substantially greater pliability than said relatively rigid member located beneath said relatively horizontally disposed member and extending across the entire lower surface of said relatively horizontally disposed member and being secured with respect thereto to form an air chamber between said flexible member and said relatively horizontally disposed member so that air may be emitted through said apertures, f. an air pump operatively retained on said apparatus for pumping air into said air chamber and is supported in upwardly spaced relationship to a floor or other supporting surface, g. a flexible strap means secured to said supporting structure and engaging an underside of said air pump to hold said air pump in said upwardly spaced relationship to said floor or other supporting structure and so that vibrational forces are not transmitted to said flexible plastic member, h. a fitting secured to said plastic member, and i. a tube connected to said air pump and to said fitting for delivery of air under pressure from said pump to said air chamber.

2. The apparatus of claim 1 wherein leg forming means is associated with and extends downwardly from said supporting structure to hold said air pump and said flexible member above said floor or other supporting surface.

3. The apparatus of claim 2 wherein said leg forming means comprises a plurality of legs.

4. The apparatus of claim 1 wherein at least one movable playing piece is disposed on said playing surface and is shiftable thereon by an air cushion formed beneath said playing piece.

5. The apparatus of claim 1 wherein said flexible member is provided with peripheral edges which are secured to peripheral portions of said relatively horizontally disposed member.

6. The apparatus of claim 1 wherein the flexible member is provided with peripheral edges and which peripheral edges of said flexible member are secured to peripheral portions of said relatively horizontally disposed member at spaced intervals therearound.

7. The apparatus of claim 1 wherein said relatively horizontally disposed member is provided with peripheral portions extending inwardly and said support structure is provided with inwardly extending flange portions and that said flexible member is provided with peripheral edge portions which are secured between said peripheral portions of said relatively horizontally disposed member and said inwardly extending flange portions.

8. The apparatus of claim 1 wherein said flexible member comprises an air impervious member which is rectangular in shape and forms a closed air pocket with said relatively horizontally disposed member, and said supporting structure is provided with an inwardly opening peripheral slot which receives and holds peripheral edges of said flexible member.

9. The apparatus of claim 1 wherein said supporting structure incudes an inwardly directed flange disposed above the peripheral portions of said playing surface.

10. The apparatus of claim 1 wherein said apparatus comprises goal means in which a player of the apparatus will attempt to move a playing piece and striker means for directing said playing piece into said goal means.

11. The apparatus of claim 10 wherein said apparatus comprises guard means positioned exteriorly of said goal means and constructed and arranged for allowing the passage of said playing piece past said guard means into said goal means while preventing the movement of said striker means beyond said guard means toward said goal means.

12. A game apparatus in which a movable playing piece is supported by an air cushion on a playing surface and two or more players attempt to propel the playing piece into the scoring area on the playing surface of an opposing player, said apparatus comprising:

a. a rectangularly shaped supporting frame and having an inwardly opening continuous slot extending around an interiorly presented surface of said frame, b. a relatively rigid and relatively flat upper member retained by and secured to said supporting frame and having a continuous peripheral end portion integral with said upper member extending into said slot for snug fitting retention therein, said upper member having an upper surface thereof forming a playing surface, c. means forming a plurality of apertures extending through said upper member and being spaced from each other throughout the greater surface area of said upper member and permitting escapement of air therethrough, d. a lower flexible plastic member of substantially greater pliability than said relatively rigid upper member retained by and operatively secured to said supporting frame and being spaced downwardly from said upper member and extending across the entire exposed lower surface of said upper member to form an air chamber therebetween, said lower member being relatively impermeable to passage of air therethrough, said lower member also having a continuous peripheral end portion integral therewith and extending into said slot and being in snug fitting engagement with said peripheral end portion on said upper member for retention in said slot, e. a rectangularly shaped peripheral lip extending upwardly from said frame above said playing surface and extending continuously around said upper member in peripheral relationship thereto, f. at least one movable playing piece capable of being disposed on said playing surface, g. an individual striker member for each player to strike the playing piece and thereby propel said playing piece over said playing surface, said striker member being manually positionable with respect to the playing surface by each player, h. a supporting means extending downwardly from said frame for supporting said upper member in a relatively horizontally disposed relationship and supporting said lower member in upwardly spaced relationship to a floor or other supporting surface, i. pumping means operatively retained by said game apparatus and having fluid tubes means connected to said flexible member and being in fluid communication with said air chamber for pumping air into said air chamber under pressure and for forcing air upwardly through said apertures to support said playing piece on said playing surface, j. said supporting means having sufficient dimension to support said pumping means on said apparatus in spaced relation to said floor or other supporting surface, k. means forming a score area at each of a pair of opposite ends of said playing surface defining areas in which a player of the game apparatus desires to move said playing piece, l. means forming an aperture in the portions of the rectangularly shaped lip adjacent each said score area, said apertures having a size and shape sufficient to permit passage of said playing piece therethrough and off of said playing surface, m. an elongate rod spacer structure mounted on the portion of the rectangularly shaped lip adjacent each said score area, each said spacer structure having a pair of end portions secured to said associated lip portion and an intermediate contact portion which extends inwardly over said playing surface, said spacer structures being located above said playing surface by a distance sufficient to enable movement of said playing piece over said playing surface into said score areas, and n. each said striker member having a player piece striking section which is sized so that it can extend at least partially under said spacer structures and an upstanding handle which is greater in vertical dimension than the height of the spacer structures above said playing surface to thereby become engageable with said spacer structures and prevent said striker members from being moved closer to said score areas than a predetermined set of positions arrayed around said score areas.

13. The apparatus of claim 12 wherein each of said score areas are goals and the bottom edge of each of said apertures being no higher than said playing surface to facilitate sliding movement of the playing piece from the playing surface through said apertures.

14. The apparatus of claim 12 wherein said spacer structure serves as a guard means which is secured to said peripheral lip and extends above said playing surface a distance greater than the height of said playing piece to prevent movement of said striker structures beyond a predetermined set of positions arrayed around said score areas, and substantially all of the area of said playing surface beneath said guard means being unobstructed for free passage of said playing piece thereover.

15. A game apparatus capable of generating an air bearing surface for supporting a movable playing piece thereon by an air cushion, said apparatus comprising:

a. a rectangularly shaped supporting frame having a plurality of legs thereon for supporting said frame in spaced relation to a floor or other support surface, b. an inwardly opening continuous slot extending around an interiorly presented surface of said rectangularly shaped supporting frame, c. a generally flat, relatively rigid, relatively horizontally disposed member retained by said frame and having an upper surface defining a playing surface, d. a continuous peripheral edge integral with said relatively horizontally disposed member and extending into said continuous slot for snug fitting retention therein, e. means defining a plurality of apertures in said relatively horizontally disposed member capable of emitting air under pressure therethrough, f. an upstanding lip extending upwardly from said playing surface and around the periphery of said relatively horizontally disposed member, g. a flexible plastic member of substantially greater pliability than said relatively horizontally disposed member located beneath and extending across the entire exposed lower surface of said relatively horizontally disposed member and being secured with respect thereto to form an air chamber between said flexible member and said relatively horizontally disposed member so that air may be emitted through said apertures, h. said flexible member also having a continuous peripheral edge integral therewith and extending into said continuous slot for snug fitting engagement therein, the continuous peripheral edge on said relatively horizontally disposed member and the continuous peripheral edge on said flexible member also being disposed in overlapping snug fitting engagement in said slot, i. pumping means operatively retained on said frame for pumping air into said air chamber, j. tube means operatively connected to said pumping means and said flexible member for delivering air from said pumping means to said air chamber, k. and at least one flexible strap means secured to said frame and extending around a portion of said pumping means to support said pumping means on said frame in upwardly spaced relationship to said floor or other support surface and to prevent vibrational forces from being transferred to said relatively horizontally disposed member.

* * * * *